United States Patent [19]

Kurashima

[11] 4,242,776

[45] Jan. 6, 1981

[54] CUFFLINK

[76] Inventor: Hideo Kurashima, Zip 110, 5-6, Negishi 2-chome, Taito-ku, Tokyo, Japan

[21] Appl. No.: 66,466

[22] Filed: Aug. 13, 1979

[30] Foreign Application Priority Data

Apr. 13, 1979 [JP] Japan ..... 54-49013[U]

[51] Int. Cl.[3] ..... A44B 5/00

[52] U.S. Cl. ..... 24/41; 24/217 R; 24/218

[58] Field of Search ..... 24/41, 42, 43, 44, 46, 24/217 R, 217 W, 218

[56] References Cited

U.S. PATENT DOCUMENTS

| | | | |
|---|---|---|---|
| 506,778 | 10/1893 | Gronberg | 24/41 |
| 644,894 | 3/1900 | Carlin | 24/43 |
| 885,419 | 4/1908 | Adams | 24/217 W |
| 908,745 | 1/1909 | Clark | 24/41 |
| 2,745,620 | 5/1956 | Murphy | 24/217 X |
| 3,107,409 | 10/1963 | Arthaud et al. | 24/218 |
| 3,220,073 | 11/1965 | Arzt | 24/41 |
| 3,643,296 | 2/1972 | Kahn | 24/217 X |
| 3,718,950 | 3/1973 | Engstrom | 24/217 |

*Primary Examiner*—Roy D. Frazier
*Assistant Examiner*—Peter A. Aschenbrenner
*Attorney, Agent, or Firm*—Cushman, Darby & Cushman

[57] ABSTRACT

The cufflink has two units which are disassemblably assembled to one another through a pair of shirt cuff button holes. For assembly, the outer end of the shank is inserted through an opening in the back of the decorative head element, pushed in further to deflect two springs inside the decorative head element and then the decorative head element is let go of, to lock the cufflink in an assembled condition. The shank is unitary with a keeper which has a recess in its inner face, for accepting and hiding from view the shirt button found beside one of the cuff button holes on so-called 'convertible cuff' shirts. For removal, the head and keeper are compressed and then relatively turned 90 degrees angularly of the shank.

12 Claims, 16 Drawing Figures

CUFFLINK

BACKGROUND OF THE INVENTION

1. Field of the Invention

The invention relates to a cufflink, more particularly to a cufflink having two units which can be locked together through a shirt cuff and which, when used on a convertible cuff, has a provision for hiding the shirt button on the cuff.

2. Description of the Prior Art

The cufflink of the present invention was developed as a more conveniently useful improvement of the cufflinks shown and described in the prior Japanese utility models Nos. 1253159, 1253166 and 1253167, all issued Oct. 31, 1978 to the present inventor.

One-piece prior art cufflinks are difficult to install. Two-piece prior art cufflinks most similar to the one of the present invention do not have an acceptable means for keeping the decorative head element from rotating from a locked to an unlocked condition, unintentionally, e.g. when the wearer unwittingly brings the cufflink being worn at his or her wrist into contact with another object.

Most prior art cufflinks when in use leave the regular shirt button of a convertible cuff exposed for view.

SUMMARY OF THE INVENTION

The cufflink has two units which are disassemblably assembled to one another through a pair of shirt cuff button holes. For assembly, the outer end of the shank is inserted through an opening in the back of the decorative head element, pushed in further to deflect two springs inside the decorative head element and then the decorative head element is let go of, to lock the cufflink in an assembled condition. The shank is unitary with a keeper which has a recess in its inner face, for accepting and hiding from view the shirt button found beside one of the cuff button holes on so called 'convertible cuff' shirts. For removal, the head and keeper are compressed and then relatively turned 90 degrees angularly of the shank.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF THE PRESENTLY PREFERRED EMBODIMENT

Figure 1:
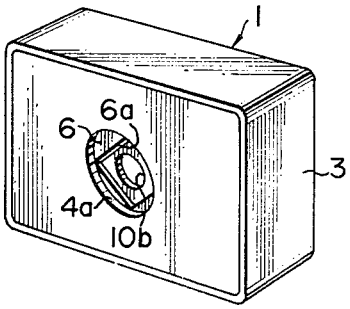
FIG. 1 is a rear perspective view of the cufflink decorative head element.
Figure 2:
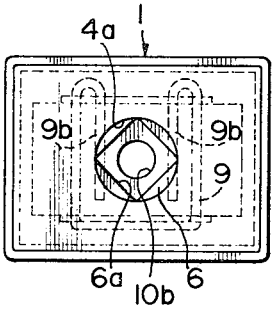
FIG. 2 is a front elevational view thereof.
Figure 6:
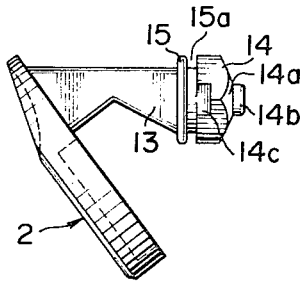
FIG. 6 is a side elevation view of the cufflink shank and keeper unit.
Figure 7:
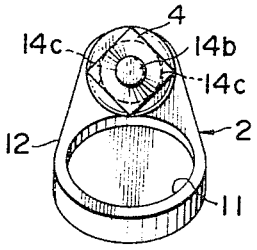
FIG. 7 is a front elevation view of the cufflink shank and keeper unit.

The cufflink of FIGS. 8–16 is constituted by two disassemblably assembled units: the decorative head element 1 shown by itself in FIGS. 1 and 2, and the shank and keeper unit shown by itself in FIGS. 6 and 7.

Figure 3:
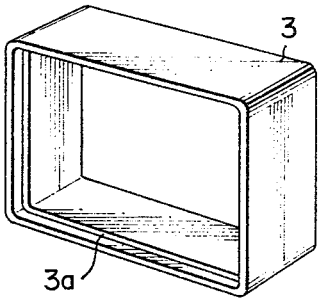
FIG. 3 is a rear perspective view of the casing shell of the cufflink decorative head element.
Figure 4:
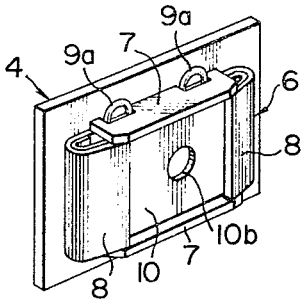
FIG. 4 is an interior-side perspective view of the rear cover plate of the cufflink decorative head element.
Figure 5:
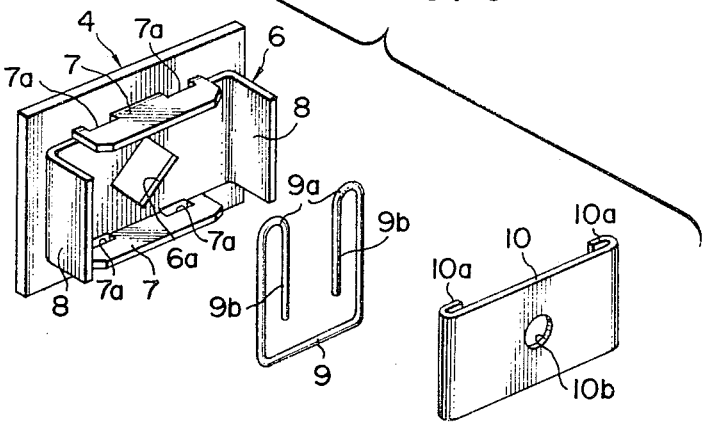
FIG. 5 is an exploded perspective view of the rear cover plate from the same aspect as FIG. 4.

FIGS. 3–5 show sub-assemblies of the decorative head element 1.

The decorative head element 1 includes a casing shell 3, which is shown from the rear in FIG. 3 being, in this instance, shaped generally like a rectangular box with an open back. When in use, it is the side wall and front wall outer surfaces of the head element 1 casing shell 3 that are visible at the outside of the shirt cuff as a decoration. The interior of the casing shell 3 is shown having a recess shoulder **3*a*** extending perimetrically of the open rear.

The decorative head element 1 further includes the latch and rear cover plate sub-assembly 4–10 which is shown from its interior side in FIG. 4 in an assembled condition, and which is shown in an exploded condition in FIG. 5.

The latch and rear cover plate sub-assembly is shown including a rear cover plate 4 that is rectangular and is sized and shaped to be received in the casing shell open rear and engaged on the shoulder **3*a*** so as to close the back of the casing shell unit. The rear cover plate is secured in place by any convenient means, such as soldering.

However, before the rear cover plate 4 is installed on the casing shell, parts 8, 9 and 10 are first installed on the interior side of the rear cover plate.

Notice now from FIGS. 1 and 2 that the rear cover plate has a circular opening **4*a*** provided centrally therethrough.

First part mounted, e.g. by soldering, on the interior side of the rear cover plate 4 is a fixture 6, which is also shown being generally rectangular and having an opening **6*a* provided centrally therethrough. However, in this instance, the opening 6*a* is of square figure and oriented so that its four sides are forty-five degrees from being parallel to respective edges of the rear cover plate. The circular opening 4*a* and square opening 6*a* are so sized and juxtaposed that, as seen in FIGS. 1 and 2**, the circular opening circumscribes the square opening.

The fixture 6 generally vertical central region is flanked by two pairs of generally laterally projecting flanges, a first pair of flanges 7 which are generally horizontal and flank the upper and lower borders of the central region and a second pair of flanges 8 which are generally vertical and flank the left and right borders of the central region.

The sub-assembly of FIGS. 4 and 5 further includes a generally planar, generally U-shaped spring clip 9 of which each leg has a distal portion 9*b* that is inwardly doubled-back at a respective knee 9*a*, so that the two portions 9*b* lie generally parallel to one another and confront one another across a gap.

It should now be noticed that where the flanges 7 join the central region of the fixture 6 each is provided with two horizontally spaced slots 7*a*. The slot 7*a* at the left of the upper flange 7 in FIG. 5 vertically registers with the slot 7*a* at the left of the lower flange 7; similarly, the two slots 7*a* at the right are in vertical registry.

The width (left to right) of each slot 7*a* is somewhat less than the corresponding dimension of each doubled back leg of the spring clip 9.

The spring clip 9 is assembled to the fixture by inserting the knees 9*a*, 9*a* into the two lower notches 7*a*, 7*a* and pushing upwardly until the central bail of the spring clip abuts the underside of the lower flange 7 and the knees 9*a*, 9*a* have become projected out through and become disposed slightly above the two upper notches 7*a*, 7*a*. Resilient compression of the spring clip legs due to their greater width, if free, than the slots holds the spring clip fast to the fixture. Note that the doubled back leg portions 9*b*, 9*b* have their lower ends located between the upper and lower flanges 7 and are not restrained, so that in the assembled condition, the doubled back portions 9*b*, 9*b* are available to be resiliently spread apart so as to temporarily widen the gap between them when necessary.

The remaining portion of the sub-assembly of FIGS. 4 and 5 is a spring plate 10 that also is shown being generally rectangular. The left and right edge marginal portions 10*a*, 10*a* are shown being doubled-over and the spring plate 10 is shown being provided with a central opening 10*b* of circular figure. The opening 10*b* is of smaller diameter than the opening 4*a*; see FIGS. 1 and 2. With the ends 10*a* doubled-over outwards, the spring plate 10 is just the right size to be snuggly received against the interior side of the central portion of the fixture 6, with the spring clip 9 being disposed generally in the plane of the doubled-over ends 10*a*, 10*a*. Then the vertical flanges 8, 8 are doublingly bent inwards around the ends 10*a* of the spring plate as shown in FIG. 4 in order to hold this part of the sub-assembly together.

The shank and keeper unit 2 will now be described with reference to FIGS. 6 and 7.

The unit 2 may be constituted by an integrally formed member. It includes a shank 13 with a base end and a head end, and a keeper 12 that is joined to the base end of the shank. The keeper 12 is generally broad and flat. When the cufflink is assembled and in use, the decorative head element 1 generally overlies the outer button hole of the shirt cuff and the keeper generally overlies the inner button holes of the same shirt cuff; the shank extends through both button holes and joins the decorative head element to the keeper. The usually visible outer surfaces of the keeper generally are finished so as to be decorative also.

In order to grip the cuff snuggly, yet allow the cuff to gradually spread to encircle the wrist, the keeper is preferably not disposed at ninety degrees to the shank, but forms an acute angle therewith as shown in FIG. 6. The inner face of the keeper, i.e. the one which faces the shank and will be disposed against the exterior of the inner end of the shirt cuff is shown preferably provided with a generally circular recess 11. The recess 11 is so located that, when the cufflink is in use on a shirt having a convertible cuff, the shirt button as usually provided on the exterior of the inner end of the shirt cuff beside the button hole in that end of the shirt cuff is wholly or mostly received into the recess 11 and is thus hidden from view.

The cufflink is completed by the structures 14*a*, 14*b*, 14*c*, 15 and 15*a* shown provided on the head end of the shank and keeper unit 2.

Structure 14*b* is an axially extending boss of circular figure, sized to be snuggly receivable through the spring plate 10 opening 10*b* from the exterior of the rear cover plate. Axially next is a radially enlarged head portion 14 of square figure sized to be snuggly receivable through the square opening 6*a* of the fixture 6 from the exterior of the rear cover plate. Surrounding the boss 14*b*, the outer end of the enlarged head portion 14 is preferably convexly beveled as at 14*a*.

Spaced axially inwardly from the axially inner extent of the enlarged head element 14, the shank 13 is shown provided with a radial flange 15 of circular figure, so that a radially outwardly opening circumferential recess 15*a* is formed axially between the enlarged head element 14 and the flange 15. Adjacent and leading to the recess 15*a*, the enlarged head element 14 has two diagonally opposite corners notched in an undercut sense as at 14*c*, these notches having a lesser axial extent than the enlarged head element 14. The two corners which are notched are the ones which face laterally outwards at the left and right of the cufflink shank.

The circumferential slot 15*a* has an axial length which is slightly greater than the thickness of the central portion of the fixture 6, i.e. perimetrically of the opening 6*a*.

Figure 9:
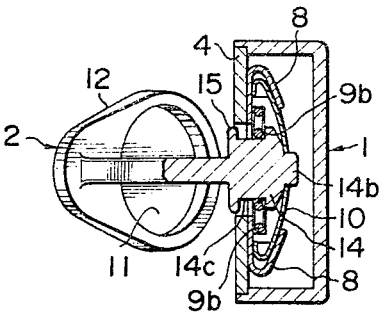
FIG. 9 is a longitudinal horizontal sectional view of the cufflink in an assembled and locked condition.
Figure 10:
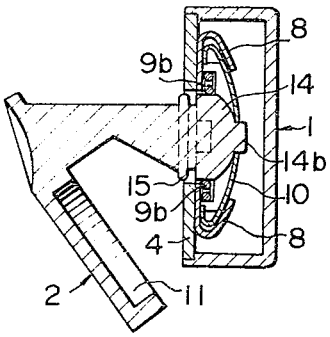
FIG. 10 is a longitudinal sectional view of the cufflink in an assembled condition but during unlocking, which is an intermediate stage when the cufflink is being removed from a shirt.

As shown in FIG. 9, and as preferred, the shank 13 is preferably relatively thin and flat in a left-to-right sense so as to be accommodated through the button holes without spreading them open. That causes less wrinkling of the cuff.

Now installation/assembly and removal/disassembly of the cufflink on and from a shirt cuff will be explained in more detail.

First, the cuff of shirt sleeve 16 is wrapped about the wrist of the wearer and the two cuff ends brought into juxtaposition so that the inner and outer button holes are substantially in registry, all as is conventionally done.

Then the head end of the shank 13 is inserted first through the inner button hole, then through the outer button hole until the enlarged head 14 projects out through the outer button hole 16*a* and the keeper 12 is against the fabric of the exterior of the inner end of the cuff. At this time, if the shirt has convertible cuffs, the cuff button is received in and hidden by the recess 11.

Figure 8:
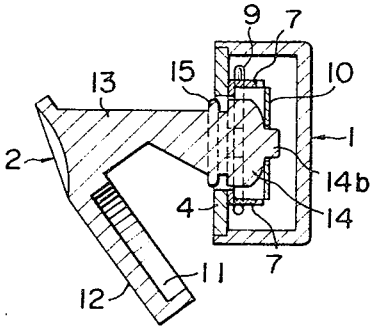
FIG. 8 is a longitudinal vertical sectional view of the cufflink in an assembled and locked condition.
Figure 11:
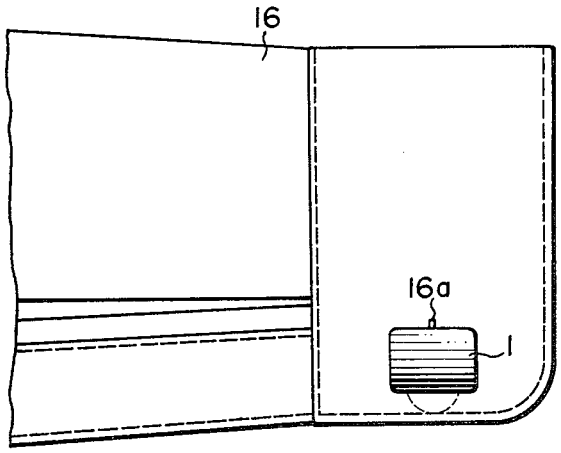
FIG. 11 is a front elevation view of the cufflink, assembled through a set of shirt cuff button holes, the cufflink being shown in a locked condition.
Figure 12:
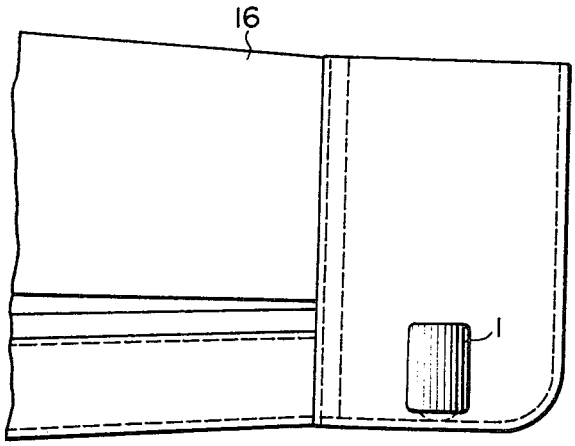
FIG. 12 is a front elevation view similar to FIG. 11, but with the cufflink in an assembled and unlocked condition.
Figure 13:
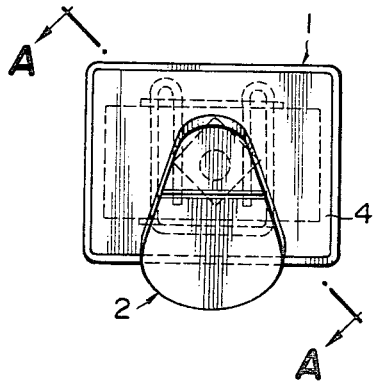
FIG. 13 is a rear elevation view of the cufflink in an assembled and locked condition.
Figure 14:
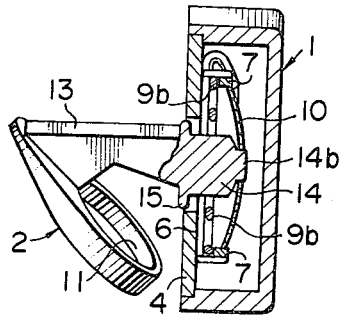
FIG. 14 is a longitudinal sectional view taken on line A—A of FIG. 13.
Figure 15:
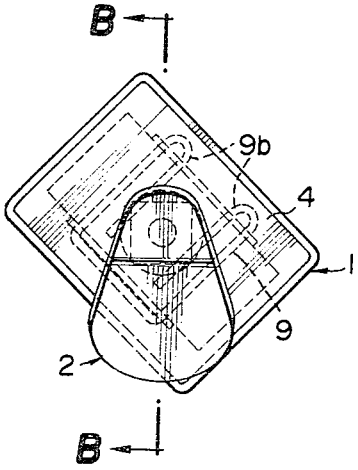
FIG. 15 is a rear elevation view of the assembled cufflink at an earlier intermediate stage, wherein the head element and shank and keeper unit are relatively rotationally displaced midway between the conditions shown in FIGS. 11 and 12.
Figure 16:
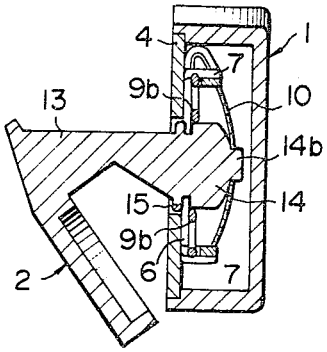
FIG. 16 is a longitudinal sectional view taken on line B—B of FIG. 15.

The wearer then picks up the decorative head element 1 and, orienting it relative to the shank and keeper unit as shown in FIGS. 8 and 11, pushes the decorative head element 1 onto the enlarged head end of the shank 13 so that the decorative head element is against the fabric of the exterior of the outer end of the cuff. The two parts 1 and 2 are then pushed together sufficiently that, within the element 1, the boss 14*b* enters the opening 10*b*, as a pilot, the square head 14 enters the square opening 6*a* and the bevel surface 14*a* engages and resiliently bows the spring plate 10.

The leading un-notched ridges of the same two corners of the square head 14 as are notched at 14*c* laterally resiliently spread the leg portions 9*b*, 9*b* of the spring clip permitting further entry, whereupon the respective spring clip leg portions 9*b*, 9*b* snap into the notches 14*c*, 14*c*. Further penetration is positively stopped as the flange 15 enters the opening 4*a* and abuts the external face of the fixture 6 perimetrically of the square opening 6*a*. In this condition, the receipt of the spring clip leg portions 9*b* in the notches 14*c* retains the decorative head element 1 on the shank 13 and the decorative head element is prevented from rotating on the shank. The resilient loading provided by the bowing of the flat spring 10 on the surface 14*a* maintains the decorative head element 1 relatively extended on the shank 13, with the spring legs 9*b* engaged in the notches 14*c*.

As the shank and keeper unit 2 is compressed towards the decorative head element 1, against the resilient force provided by the spring plate 10, the radial flange 15 contacts the fixture plate 6 perimetrically of the square opening 6*a*, thus limiting further incursion. This movement radially aligns the circumferential slot 15*a* with the thickness of the fixture plate 6 within the opening 6*a*. See FIG. 16. In this axial disposition, the parts 1 and 2 are relatively angularly rotatable and upon rotation of the decorative head element 1 through 90 degrees, the enlarged head portion 14 of square figure is angularly aligned with the opening 6*a*. If manual compressive force pushing 1 and 2 axially together is released, the recovering spring 10 will push the enlarged head 14 out of the opening 6*a*, thus releasing the decorative head element 1 from the shank and keeper unit 2.

It should now be apparent that the cufflink as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A cufflink, comprising:

two enlarged elements, the first being free and the second having an attached shank;

the shank having an enlarged free end portion and an axially adjacent portion of non-circular transverse cross-sectional figure;

the shank further having laterally outwardly opening notch means associated with said non-circular portion;

said first enlarged element being hollow and having a back through which an opening communicates with the interior thereof;

said opening having a portion of non-circular transverse cross-sectional figure sized to permit receipt of said non-circular portion of said shank therethrough in each of two different angular orientations;

said first enlarged element housing a first spring and a second spring;

the first spring being adapted, positioned and mounted to be intercepted by and resiliently loaded by engagement with said enlarged free end portion of said shank is inserted through said opening with said shank non-circular portion being in a first said angular orientation relative to said opening non-circular portion and said shank free end pushed further into the interior of said first enlarged element;

the second spring being adapted, positioned, and mounted to snap into said notch means and to remain therein as further pushing is relaxed, whereupon said first spring, recovering slightly causes said shank non-circular portion to become closely surrounded for at least part of the axial extent thereof by said opening non-circular portion, so that engagement of the second spring in the notch prevents withdrawal of the shank from the opening and close surrounding of the shank non-circular portion by the opening non-circular portion prevents substantial angular rotation of said first enlarged element relative to said second enlarged element, but so that upon further pushing of said shank into said opening, said shank non-circular portion fully axially passes said opening non-circular portion, whereupon said first enlarged element may be angularly rotated relative to said second enlarged element to sequentially cam said second spring out of said notch and bring said shank non-circular portion into said second angular orientation relative to said opening non-circular portion so that said first spring, upon relaxation of said further pushing, may substantially eject said shank from said opening permitting separation of said first enlarged element from said second enlarged element.

2. The cufflink of claim 1, wherein:

one of said first and second enlarged elements is constituted by a decorative head element and the other of said first and second enlarged elements comprises a keeper having a rear face which includes a recess which is sized, shaped and positioned to accept and hide a convertible cuff shirt button upon being installed through the two cuff button holes of a conventional convertible cuff.

3. The cufflink of claim 2, wherein:

said keeper is provided integrally with said shank on said second enlarged element.

4. The cufflink of claim 1, wherein:

said first spring is a flat spring which becomes bowed upon being resiliently loaded.

5. The cufflink of claim 4, wherein:

said flat spring includes a pilot hole therethough and said shank further having a smaller tip which is sized and shaped to enter said pilot hole until said shank enlarged free end portion engages and begins bowing flat spring.

6. The cufflink of claim 1, wherein:

said shank non-circular portion and said opening non-circular portion each are of substantially square non-circular figure.

7. The cufflink of claim 6, wherein:

said notch means associated with said shank non-circular portion is constituted by two diametrically opposed apical notches extending only part way along the axial extent of said shank non-circular portion from that end of said shank non-circular portion which lies axially furthest from said shank free end.

8. The cufflink of claim 7, wherein:

said opening further includes an exteriorly-facing stop shoulder axially outwardly of said opening non-circular portion; and said shank further includes a radial flange positioned for engagement with said stop shoulder to limit incursion of said shank into the interior of said first enlarged element via said opening during said further pressing.

9. The cufflink of claim 7, wherein:

said first spring is a flat spring which becomes bowed upon being resiliently loaded.

10. The cufflink of claim 9, wherein:

the first enlarged element is constituted by a casing shell having a cover plate secured thereto as a closure therefor;

said cover plate having an opening generally centrally therethrough;

said cover plate having an interior face;

a fixture being mounted to said interior face;

said fixture being of four-edged generally rectangular form and having at its four edges two mutually opposed pairs of inwardly projecting flanges;

said fixture having a square opening generally centrally therethrough;

said first spring being mounted between a first said pair of flanges and said second spring being mounted between the second said pair of flanges;

said opening through said cover plate and said square opening through said fixture together constituting said opening into the interior of said first enlarged element.

11. The cufflink of claim 10, wherein:

said flat spring has two opposite ends and the flanges of said first pair are doubled back around said two opposite ends of said flat spring to mount said flat spring.

12. The cufflink of claim 10, wherein:

said second spring is of generally U-shape, with two legs that are doubled back inwardly so as to have two laterally spaced knees and two generally parallel, laterally spaced distal portions;

each of said flanges of said second pair having two laterally spaced slots formed therethrough; the knees being inserted through a respective slot in each said second flange in order to dispose said second spring distal portions between said second flanges so that from the exterior of said one enlarged element said second spring distal portions are visible cutting across in back of two diagonally opposite corners of said square opening.

* * * * *